US009911567B2

(12) United States Patent
Schwartz et al.

(10) Patent No.: US 9,911,567 B2
(45) Date of Patent: Mar. 6, 2018

(54) DISCONNECT SWITCH WITH INTEGRATED THERMAL BREAKER

(71) Applicant: LITTELFUSE, INC., Chicago, IL (US)

(72) Inventors: Geoffrey Schwartz, Stockton, MA (US); Joe Thomas, Reading, MA (US); Dana Scribner, Tyngsboro, MA (US)

(73) Assignee: Littlfuse, Inc., Chicago, IL (US)

( * ) Notice: Subject to any disclaimer, the term of this patent is extended or adjusted under 35 U.S.C. 154(b) by 0 days.

(21) Appl. No.: 14/733,369

(22) Filed: Jun. 8, 2015

(65) Prior Publication Data

US 2016/0358738 A1 Dec. 8, 2016

(51) Int. Cl.

| | |
|---|---|
| ***H01H 89/04*** | (2006.01) |
| ***H01H 71/16*** | (2006.01) |
| ***H01H 19/14*** | (2006.01) |
| ***H01H 69/00*** | (2006.01) |
| ***H01H 37/52*** | (2006.01) |
| *H01H 37/54* | (2006.01) |

(52) U.S. Cl.

CPC ..... *H01H 89/04* (2013.01); *H01H 19/14* (2013.01); *H01H 37/52* (2013.01); *H01H 71/16* (2013.01); *H01H 37/54* (2013.01)

(58) Field of Classification Search

CPC ..... H01H 89/04; H01H 37/52; H01H 37/54; H01H 71/16; H01H 69/00; H01H 19/14

USPC ..... 337/300, 333, 343, 348

See application file for complete search history.

(56) References Cited

U.S. PATENT DOCUMENTS

| | | | | | |
|---|---|---|---|---|---|
| 2,293,179 | A * | 8/1942 | Swingle | H01H 77/04 | 337/91 |
| 2,300,530 | A * | 11/1942 | Swingle | H01H 77/04 | 337/62 |
| 3,496,511 | A * | 2/1970 | Colavecchio | H01H 37/5427 | 337/343 |
| 3,621,434 | A * | 11/1971 | Gerich | H01H 37/5409 | 337/248 |
| 3,686,605 | A * | 8/1972 | Hire | H01H 89/04 | 337/334 |
| 3,715,699 | A * | 2/1973 | Hire | H01H 37/5409 | 337/348 |
| 3,720,899 | A * | 3/1973 | Hire | H01H 37/08 | 337/348 |
| 3,832,667 | A * | 8/1974 | Blanton | H01H 37/26 | 337/348 |
| 3,852,697 | A * | 12/1974 | Snider | H01H 37/54 | 337/348 |

(Continued)

*Primary Examiner* — Anatoly Vortman

(57) ABSTRACT

A disconnect switch is disclosed with an integrated thermal breaker that can be disposed between a source of power and a circuit to be protected. The disconnect switch can comprise a housing, a first terminal coupled to a power source and a second terminal coupled to a load. The first terminal and the second terminal can be partially included in the housing. The disconnect switch comprises a bi-metal thermal conductive element made from at least two metal sheets with different thermal expansion coefficients and having a concave shape that engages the first and second terminals. Upon occurrence of an overload condition, heat flowing through the bi-metal thermal conductive element causes the concave shape to retract to a convex shape and disengage the bi-metal thermal conductive element from the first and the second terminals.

8 Claims, 3 Drawing Sheets

(56) References Cited

U.S. PATENT DOCUMENTS

| | | | | | |
|---|---|---|---|---|---|
| 4,306,211 | A * | 12/1981 | Hofsass | H01H 37/54 | 337/365 |
| 5,929,742 | A * | 7/1999 | Short | H01H 37/5409 | 337/327 |
| 8,614,618 | B2 * | 12/2013 | Darr | H01H 9/10 | 337/143 |
| 2006/0279397 | A1 * | 12/2006 | Rose | H01H 37/5409 | 337/312 |

* cited by examiner

DISCONNECT SWITCH WITH INTEGRATED THERMAL BREAKER

FIELD OF THE INVENTION

Embodiments of the invention relate to the field of circuit protection devices. More particularly, the present invention relates to a disconnect switch with an integrated thermal breaker.

DISCUSSION OF RELATED ART

Circuit interrupters or circuit breakers, such as, battery disconnect switches, are employed to provide protection for the electrical power circuit of a vehicle. For example, some vehicles, such as trucks and cars, employ direct current (DC) disconnecting switches to provide a rapid mechanism to disconnect batteries or other DC power supplies in the event of serious electrical faults. Disconnecting switches may also be employed by vehicles, such as, for example, electric vehicles such as golf carts and fork lifts, to disconnect alternating current (AC) power supplies.

Prior attempts to accommodate such loads employed an operating mechanism for the battery disconnect device which, for example, has an arrangement of switches or relays paired with circuit protection devices that require heavy gauge wiring. However, such designs are complex, expensive, and have a large footprint that takes up significant space in a relatively small area, such as a battery box. Also, many resettable high amperage circuit breakers must be sufficiently heated to reach a malleable state for switching the disconnect switch to the "off" position. It is with respect to these and other considerations that the present improvements have been needed.

SUMMARY OF THE INVENTION

A need exists for a high amperage disconnect switch by integrating a high amperage thermal breaker into a disconnect switch. Exemplary embodiments of the present disclosure are directed to a disconnect switch, such as a mechanical disconnect switch disposed between a source of power and a circuit to be protected. A thermal breaker can be integrated with the disconnect switch that can be disposed between a source of power and a circuit to be protected. The disconnect switch may comprise a housing, a first terminal coupled to a power source, and a second terminal coupled to a load. The first terminal and the second terminal can be partially included in the housing. The disconnect switch can comprise a bi-metal thermal conductive element made of, for example, at least two metal sheets with different thermal expansion coefficients. An operating mechanism can be coupled to the bi-metal thermal conductive element and configured to open and close the bi-metal thermal conductive element with the first terminal and the second terminal. The bi-metal thermal conductive element may have a concave shape and electrically engage with the first terminal and the second terminal upon respective application of power to the load. Upon occurrence of an overload condition, heat flowing through the bi-metal thermal conductive element causes the concave shape to retract to a convex shape and disengage the bi-metal thermal conductive element from the first terminal and the second terminal.

DETAILED DESCRIPTION OF EMBODIMENTS

Figure 1:
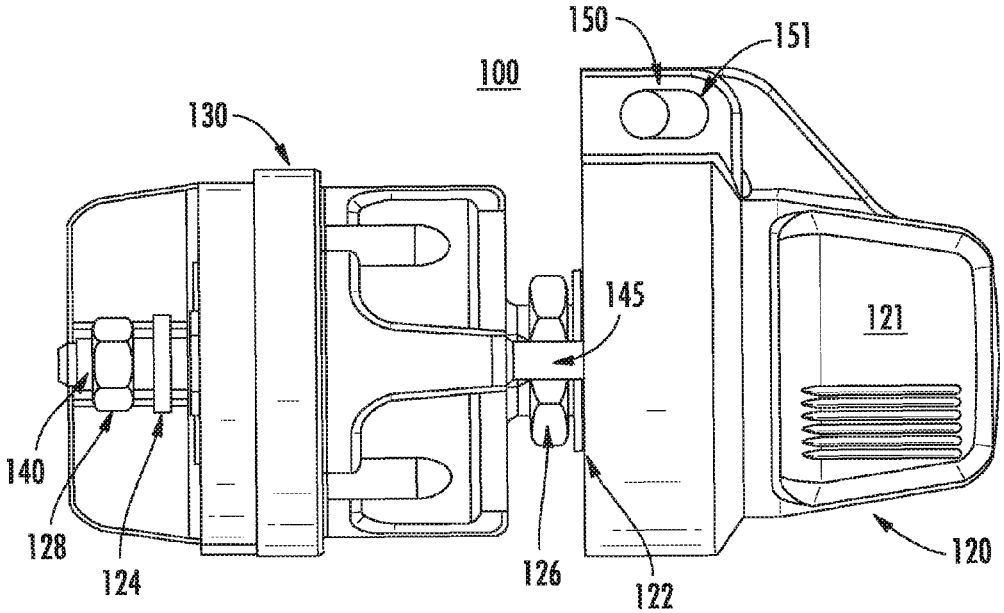
FIG. 1 illustrates a side view of mechanical disconnect switch in accordance with an embodiment of the present disclosure.

FIG. 1 is a side view of mechanical disconnect switch 100 which includes a switch assembly 120 (e.g., a switch), a safety lock 150, washers or spacers 122, 124, securing nuts 126, 128 (or other fasteners), shaft 145, a base section 130, and a terminal 140 which may be, for example, a post, screw, and/or conductive stud/screw. The switch assembly 120 is coupled to the base section 130 via shaft 145 of the switch assembly 120. The securing nuts 126, 128 in combination with the washers 122, 124 are used to secure the terminal 140 to the base section 130 and may be positioned along one or more locations of shaft 145. The switch assembly 120 may include a knob 121 which when manually turned, rotates the shaft 145 and to an open and/or close the switch 100. In particular, when the switch 100 is rotated to an "on" position, electrical current is supplied from a power source to a load and when switch 100 is rotated to an "off" position, electrical current from the power source to the load is interrupted. That is, the mechanical disconnect switch 100 functions to interrupt power supplied to an electrical circuit or to a group of electrical circuits, which deenergizes the circuit for operational safety and protection.

As mentioned above, switch assembly 120 also includes safety lock 150 which may have a central aperture 151 capable of receiving a locking device, such as a padlock. The safety lock 150 provides that inadvertent operation is not possible (e.g., lockout-tagout).

It should be noted that FIG. 1 illustrates only one terminal 140 but in other embodiments the mechanical disconnect switch 100 may include one or more terminals coupled to the base section 130. In one embodiment, the base section 130 can function to house the terminal 140 and can be made from an insulating material such as, for example, a ceramic material capable of withstanding torque forces associated with connection of the switch 100 via a post configuration as described in more detail below.

Figure 2:
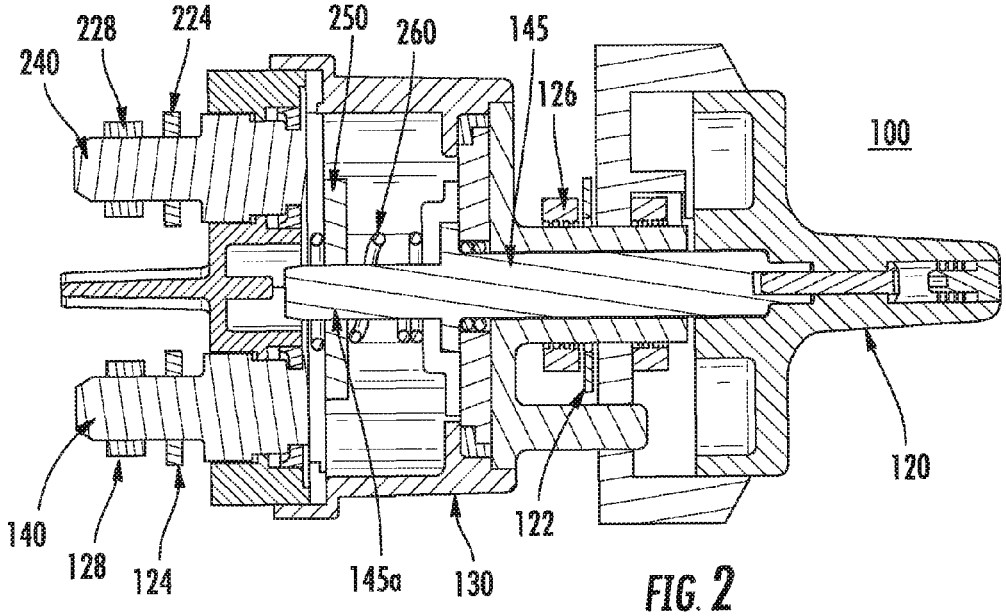
FIG. 2 is a cross sectional view of the mechanical disconnect switch shown in FIG. 1.

FIG. 2 is a cross sectional view of mechanical disconnect switch 100 shown in FIG. 1 illustrating terminals 140, 240, spring 260, and electrical contact 250. The terminals 140, 240 can be coupled to the base section 130 using washers 122, 124 and securing nuts 126, 128. In one embodiment, terminals 140, 240 can be partially housed within the base section 130 where a portion of terminals 140, 240 is positioned outside of the base section 130.

Spring 260 is housed within the base section 130 and be coupled to the shaft 145 which is also coupled to electrical contact 250. Although the electrical contact 250 is shown as being positioned toward a first end 145*a* of shaft 145, it may be disposed along a variety of positions on shaft 145. Electrical contact 250 electrically connects the terminals 140, 240 when the switch 100 is mechanically turned to a closed position (e.g., current is allowed to flow from terminal 140 via the electrical contact 250 to terminal 240).

Similarly, electrical contact 250 is used to electrically disconnect the terminals 140, 240 when the switch assembly is mechanically turned to an open position (e.g., the flow of current from terminal 140 via the electrical contact 250 to the terminal 150 is interrupted/terminated).

The spring 260 coupled to the shaft 145 allows the mechanical disconnect switch 100 to function as a rotary switch and/or a plunger switch. In other words, the switching assembly 120 can be of a rotary style disconnect switch and/or a plunger style disconnect switch for electrically connecting and/or disconnecting terminals 140, 240 via electrical contact 250.

In one embodiment, terminals 140, 240 can be connected to a source of electrical power such as, for example, a battery and a load. For example, terminal 140 can be electrically coupled to the power load and terminal 240 can be electrically coupled to the power source. The switching assembly 120 can include, without limitation, a manual ON/OFF switch or knob 121, cooperating with shaft 145 for positioning the electrical contact 250 to open and close the electrical contact 250 thus allowing or preventing current to flow between terminals 140 and 240. The mechanical disconnect switch 100 may be configured to trip or open the electrical contact 250 in response to at least one of an arc fault condition, an overload condition, and/or a short circuit condition thereby preventing current from flowing between terminals 140 and 240.

Figure 3A:
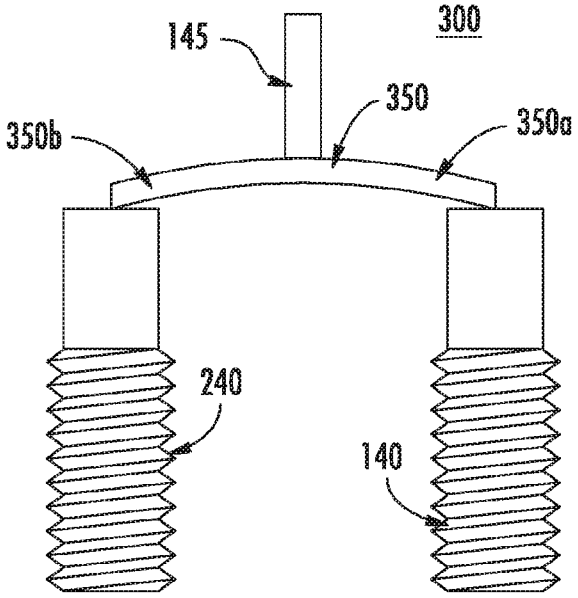
FIG. 3A illustrates a perspective view of integrated thermal breaker in the mechanical disconnect switch of FIG. 2.

FIG. 3A illustrates an integrated thermal breaker 300 employed in the mechanical disconnect switch 100. A bi-metal thermal conductive element 350 (e.g., a thermal circuit breaker) may be coupled to the shaft 145 of the switching assembly 120. That is, the electrical contact 250, as depicted in FIG. 2, can be replaced by the bi-metal thermal conductive element 350. The bi-metal thermal conductive element 350 may have a first end 350*a* in electrical contact with terminal 140 and a second end 350*b* in electrical contact with terminal 240.

Figure 3B:
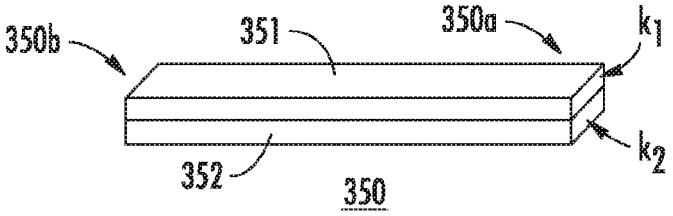
FIG. 3B illustrates an exemplary bi-metal thermal conductive element shown in FIG. 3A.

The bi-metal thermal conductive element 350 may be made of a plurality of metal sheets with different thermal expansion coefficients. For example, the bi-metal thermal conductive element 350 may comprise a metal alloy, nickel, iron, manganese, chromium, copper, steel, brass, aluminum, or a combination thereof where a first metal sheet can be copper and the second metal sheet can be nickel. FIG. 3B illustrates an exemplary bi-metal thermal conductive element 350 having a first metal sheet 351 and a second metal sheet 352. The bi-metal conductive element 350 is shown as being relatively flat as compared to the same element shown in FIG. 3A for ease of explanation. The first end 350*a* of the first metal sheet 351 of the bi-metal conductive element 350 may have a thermal expansion coefficient $k_1$ and the first end 350*a* of the second metal sheet 352 may have a thermal expansion coefficient $k_2$ where $k_2<k_1$. Thus, the bi-metal thermal conductive element 350 may be comprised of these metal sheets having different thermal expansion coefficients in order to calibrate the switch 100 for a particular rating.

In one embodiment, the switching assembly 120, having the shaft 145, can be configured to open and close the bi-metal thermal conductive element 350 with terminals 140, 240. For example, during operation, when the switching assembly 120 is turned, rotated, and/or positioned to a closed position, a load current flows from a power source, such as a battery, to a load through the bi-metal thermal conductive element 350 via terminals 140, 240. Alternatively, when the switching assembly 120 is turned, rotated, and/or positioned to an open position, a load current flowing from the power source to the load via terminals 140, 240 is interrupted by the disengagement of either end 350*a* and/or 350*b* of the thermal conductive element 350.

The bi-metal thermal conductive element 350 is illustrated having an arcuate shape (e.g., concave) formed between ends 350*a* and 350*b* when there is no overload condition (e.g., a steady state condition) in the mechanical disconnect switch 100. In other words, a center portion 350*c* of the bi-metal thermal conductive element 350 bulges outward away from terminals 140, 240 and each end 350*a* and 350*b* of the bi-metal thermal conductive element 350 curves inward towards the terminals 140, 240. The bi-metal thermal conductive element 350 maintains the concave shape when either (1) no current is flowing through bi-metal thermal conductive element 350, and/or (2) when the current flowing through each metal sheet in the bi-metal thermal conductive element 350 generates heat that is less than the thermal expansion coefficients for changing shape and/or volume of the bi-metal thermal conductive element 350. As such, the mechanical disconnect switch 100 can be considered a high current breaker where "high" may be in the range of 200-500 A. Table 1 below provides exemplary thermal expansion coefficients (k) for exemplary metal sheet materials such as iron and copper.

TABLE 1

| Material | ($10^{-6}$ m/(m K))*) | ($10^{-6}$ in/(in ° F.))*) |
|---|---|---|
| Iron | 12.0 | 6.7 |
| Copper | 16.6 | 9.3 |

Figure 4:
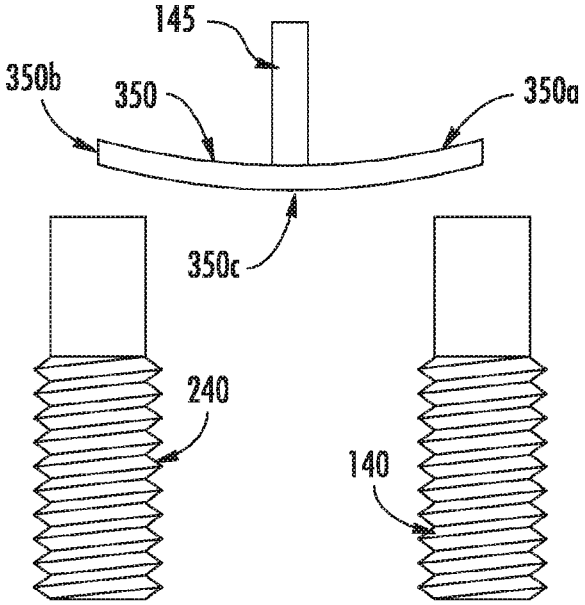
FIG. 4 illustrates a perspective view of tripped integrated thermal breaker in the mechanical disconnect switch of FIG. 2.

FIG. 4 illustrates a "tripped" or open integrated thermal breaker 300 in the mechanical disconnect switch 100. Upon occurrence of an overload condition, heat flowing through the bi-metal thermal conductive element 350 causes the arcuate shape (e.g., concave shape) to retract to a planar shape or recurved shape (opposite of the arcuate shape). This forces the ends 350*a* and 350*b* of the bi-metal thermal conductive element 350 to disengage from the terminals 140, 240 respectively. In this manner, when an overcurrent condition occurs, the ends 350*a* and 350*b* of the bi-metal thermal conductive element 350 are displaced upward and away (e.g., tripped) from terminals 140, 240 thereby interrupting current flow from a power source to a load via the mechanical disconnect switch 100. Heat flowing through the sheets of the bi-metal thermal conductive element 350 causes the concave shape of the bi-metal thermal conductive element 350 to retract or "trip" to a convex shape and disengage the ends 350*a* and 350*b* of the bi-metal thermal conductive element 350 from the terminals 140, 240. A center portion 350*c* of the bi-metal thermal conductive element 350 curves toward terminals 140, 240, and each end 350*a*, 350*b* of the bi-metal thermal conductive element 350 retracts away from the terminals 140, 240. The bi-metal thermal conductive element 350 can return to the arcuate shape (concave shape) upon the operating mechanism being turned to a closed position. For example, turning the switching assembly 120 to an open position (e.g., an off position to stop the flow of current), the bi-metal thermal conductive element 350 is "snapped" back into the untripped position/steady state. That is, the bi-metal thermal conductive element 350 is changed from the convex shape back to the concave shape illustrated in FIG. 3. Also, upon turning the switching assembly 120 to a closed position (e.g., an on position for allowing current to flow by electrically engaging the ends of the bi-metal thermal conductive element 350 with terminals 140, 240), a load current can be restored which flows through the mechanical disconnect switch 100.

The bi-metal thermal conductive element 350 can return to the arcuate shape (concave shape) when the temperature of the metal sheets in the bi-metal thermal conductive element 350 cools to a temperature below the thermal expansion coefficients. For example, following the ends 350*a*, 350*b* of the bi-metal thermal conductive element 350 being displaced away (e.g., tripped) from terminals 140, 240 due to the heat in the metal sheets, following a cooling period, each of the ends 350*a*, 350*b* of bi-metal thermal conductive element 350 may return to the concave shape and return to electrically contact with terminals 140, 240 without turning the switching assembly 120.

Thus, as provided herein, the mechanical disconnect switch 100 provides one or more benefits by providing a resettable high amperage mechanical disconnect switch with a switching assembly 120 that is more efficient to turn because of the leverage provided by the handle/knob independent of the temperature of the bi-metal thermal conductive element 350. Also, the integrated thermal breaker (e.g., the bi-metal thermal conductive element 350) allows the mechanical disconnect switch 100 to be a resettable high amperage mechanical disconnect switch without engaging the switching assembly 120 on or off following a cooling period. In other words, the bi-metal thermal conductive element 350 can automatically both electrically engage and/or disengage from the terminals 140, 240 depending on the temperature of the bi-metal thermal conductive element 350 being greater than and/or less than the thermal expansion coefficients for changing shape and/or volume for both metal sheets in the bi-metal thermal conductive element 350.

Figure 5:
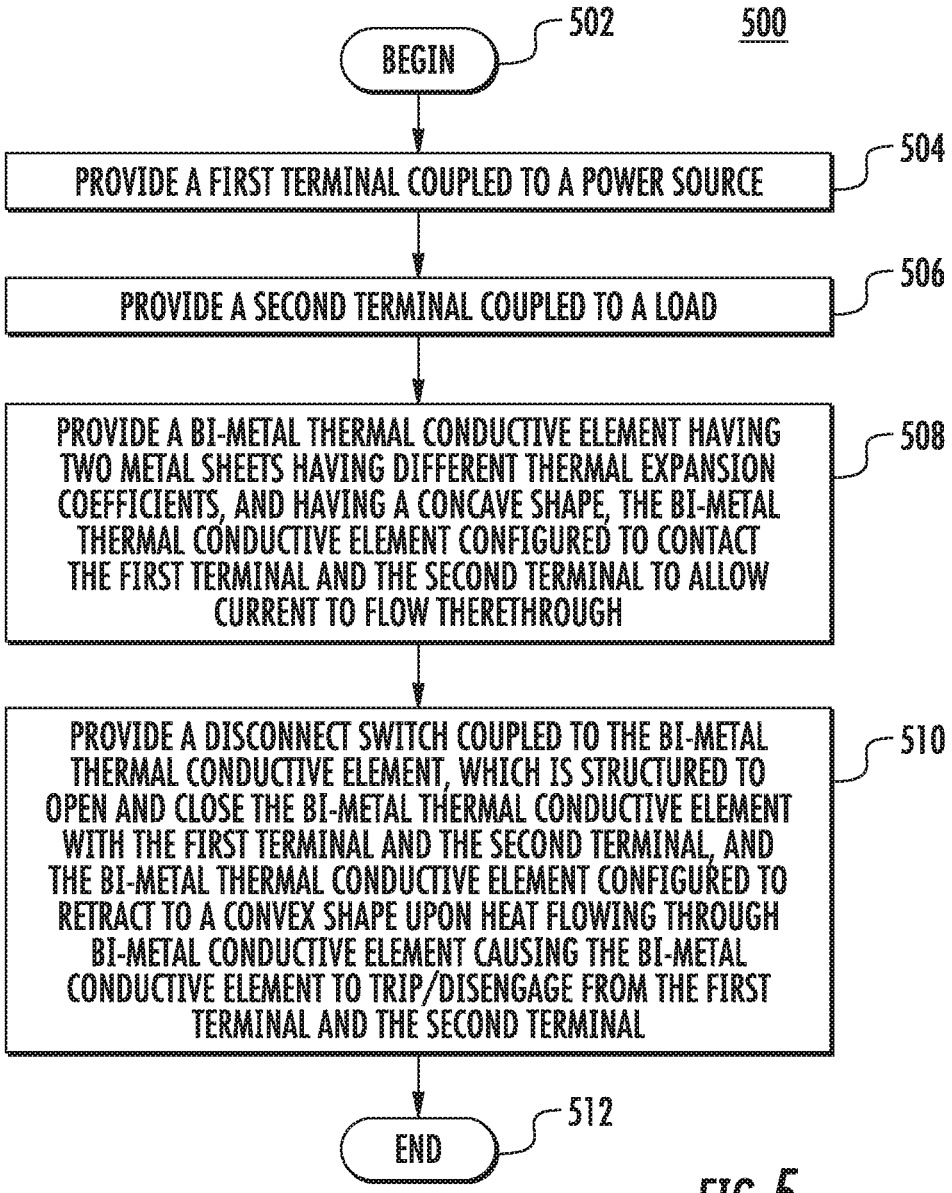
FIG. 5 is a flow chart of a method of manufacturing a mechanical disconnect switch with an integrated thermal breaker.

FIG. 5 is a flow chart of a method of manufacturing 500 a mechanical disconnect switch with an integrated thermal breaker. In one embodiment, the method of manufacturing 500 begins (502) by providing a first terminal coupled to a power source (block 504). The method of manufacturing 500 can provide a second terminal coupled to a load (block 506). The first terminal and the second terminal can be at least partially included in the housing. The method of manufacturing 500 can provide a bi-metal thermal conductive element (block 508). The bi-metal thermal conductive element can be made of at least two metal sheets with different thermal expansion coefficients. The bi-metal thermal conductive element is configured to electrically contact the first terminal and the second terminal. The method of manufacturing 500 can provide a disconnect switch coupled to the bi-metal thermal conductive element, and the disconnect switch can be structured to open and/or close the bi-metal thermal conductive element with the first terminal and the second terminal (block 510). The bi-metal thermal conductive element can have an arcuate shape (concave) electrically engaged (and/or while in a steady state condition) with the first terminal and the second terminal upon respective application of power to the load. Upon occurrence of an overload condition, heat flowing through the bi-metal thermal conductive element causes the arcuate shape (concave shape) to retract to a planar shape and/or convex shape and disengage the bi-metal thermal conductive element from the first terminal and the second terminal. The method of manufacturing 500 ends (step 512).

Thus, as described herein, the various embodiments described herein provide for a circuit protection assembly for a mechanical disconnect switch having integrated fuse protection. The disconnect switch with an integrated thermal breaker that can be disposed between a source of power and a circuit to be protected. The disconnect switch can comprise a housing. The disconnect switch can comprise a first terminal coupled to a power source. The disconnect switch can comprise a second terminal coupled to a load. The first terminal and the second terminal can be partially included in the housing. The disconnect switch can comprise a bi-metal thermal conductive element. The bi-metal thermal conductive element can be made of at least two metal sheets with different thermal expansion coefficients. An operating mechanism can be coupled to the bi-metal thermal conductive element. The operating mechanism can be structured to open and close the bi-metal thermal conductive element with the first terminal and the second terminal. The bi-metal thermal conductive element can have a concave shape and electrically engage with the first terminal and the second terminal upon respective application of power to the load. Upon occurrence of an overload condition, heat flowing through the bi-metal thermal conductive element causes the concave shape to retract to a convex shape and disengage the bi-metal thermal conductive element from the first terminal and the second terminal.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed is:

1. A circuit protection assembly for a mechanical disconnect switch having an integrated thermal breaker comprising:

a housing;

a first terminal;

a second terminal, the first terminal and the second terminal at least partially disposed within the housing;

a bi-metal thermal conductive element, the bi-metal thermal conductive element being made of at least two metal sheets having different coefficients of thermal expansion; and an operating mechanism including a shaft coupling the bi-metal thermal conductive element to a switch, the switch being rotatable about an axis of the shaft to move the bi-metal thermal conductive element between a first position, in which the bi-metal thermal conductive element cannot engage the first terminal and the second terminal, and a second position, in which the bi-metal thermal conductive element can engage the first terminal and the second terminal, the bi-metal thermal conductive element having a concave shape while electrically engaged with the first terminal and the second terminal, wherein upon occurrence of an overload condition, heat flowing through the bi-metal thermal conductive element causes the concave shape to retract to a convex shape and disengages the bi-metal thermal conductive element from the first terminal and the second terminal;

wherein the bi-metal thermal conductive element is configured to automatically return to the concave shape and reestablish electrical engagement with the first terminal and the second terminal upon the bi-metal thermal conductive element cooling to a predetermined temperature.

2. The circuit protection assembly of claim 1, wherein the bi-metal thermal conductive element comprises one of a metal alloy, nickel, iron, manganese, chromium, copper, steel, brass, aluminum, or a combination thereof.

3. The circuit protection assembly of claim 1, wherein the bi-metal thermal conductive element is configured to return to the concave shape upon the bi-metal thermal conductive element being moved to the first position.

4. The circuit protection assembly of claim 3, wherein a load current can flow from a power source to a load through the bi-metal thermal conductive element while the bi-metal thermal conductive element electrically engages with the first terminal and the second terminal.

5. The circuit protection assembly of claim 1, wherein the bi-metal thermal conductive element is calibrated to a predetermined amperage.

6. The circuit protection assembly of claim 1, wherein the mechanical disconnect switch is a high current circuit breaker.

7. A method of manufacturing a mechanical disconnect switch having an integrated thermal breaker comprising:

providing a housing;

providing a first terminal;

providing a second terminal, the first terminal and the second terminal at least partially included in the housing;

providing a bi-metal thermal conductive element, the bi-metal thermal conductive element being made of at least two metal sheets with different thermal expansion coefficients; and providing a disconnect switch coupled to the bi-metal thermal conductive element by a shaft, the disconnect switch being rotatable about an axis of the shaft to move the bi-metal thermal conductive element between a first position, in which the bi-metal thermal conductive element cannot engage the first terminal and the second terminal, and a second position, in which the bi-metal thermal conductive element can engage the first terminal and the second terminal, the bi-metal thermal conductive element having a concave shape while electrically engaged with the first terminal and the second terminal, wherein upon occurrence of an overload condition, heat flowing through the bi-metal thermal conductive element causes the concave shape to retract to a convex shape and disengage the bi-metal thermal conductive element from the first terminal and the second terminal, wherein the bi-metal thermal conductive element is configured to automatically return to the concave shape and reestablish electrical engagement with the first terminal and the second terminal upon the bi-metal thermal conductive element cooling to a predetermined temperature.

8. The method of manufacturing of claim 7, wherein the bi-metal thermal conductive element is configured to return to the concave shape when the bi-metal thermal conductive element is moved to the first position.

* * * * *